US008241138B2

(12) United States Patent
Maglaque et al.

(10) Patent No.: US 8,241,138 B2
(45) Date of Patent: Aug. 14, 2012

(54) APPARATUSES, METHODS AND SYSTEMS FOR IMPROVING SPORTS PLAYING ABILITIES

(76) Inventors: Peter Maglaque, San Diego, CA (US); Thomas McGinnis, Encinitas, CA (US)

( * ) Notice: Subject to any disclaimer, the term of this patent is extended or adjusted under 35 U.S.C. 154(b) by 211 days.

(21) Appl. No.: 12/692,571

(22) Filed: Jan. 22, 2010

(65) Prior Publication Data

US 2010/0261542 A1 Oct. 14, 2010

Related U.S. Application Data

(60) Provisional application No. 61/212,220, filed on Apr. 9, 2009.

(51) Int. Cl.
*A63B 53/00* (2006.01)

(52) U.S. Cl. ..... 473/282; 473/201; 473/300; 473/324; 473/316

(58) Field of Classification Search ..... 473/300–303, 473/251, 305, 254, 242, 316, 201
See application file for complete search history.

(56) References Cited

U.S. PATENT DOCUMENTS

| | | | | | |
|---|---|---|---|---|---|
| 1,126,208 | A * | 1/1915 | Mattern | 473/201 |
| 1,433,150 | A * | 10/1922 | Reach | 473/251 |
| 1,587,082 | A * | 6/1926 | Mattern | 473/201 |
| 2,446,622 | A * | 8/1948 | Turner | 69/21 |
| D160,396 | S * | 10/1950 | Karns | D21/756 |
| 2,865,635 | A * | 12/1958 | Jessen | 473/201 |
| 4,222,567 | A * | 9/1980 | Shabala | 473/242 |
| 4,317,568 | A * | 3/1982 | Green | 473/238 |
| 4,484,746 | A * | 11/1984 | Brill | 473/251 |
| 4,569,525 | A * | 2/1986 | Folger | 473/242 |
| 5,228,695 | A * | 7/1993 | Meyer | 473/238 |
| 5,234,217 | A * | 8/1993 | Johnson | 473/238 |
| 5,890,977 | A * | 4/1999 | Taylor | 473/409 |
| 6,648,770 | B1 * | 11/2003 | Snyder | 473/238 |
| 6,652,388 | B1 * | 11/2003 | Lenhof et al. | 473/306 |
| 7,017,252 | B2 * | 3/2006 | Lenhof et al. | 29/464 |
| 7,637,821 | B2 * | 12/2009 | Johnson | 473/202 |
| 7,883,430 | B2 * | 2/2011 | Thomas et al. | 473/307 |
| 8,061,008 | B2 * | 11/2011 | Thomas et al. | 29/525.01 |
| 8,075,417 | B2 * | 12/2011 | Thomas et al. | 473/246 |
| 2007/0123364 | A1 * | 5/2007 | Solari | 473/201 |
| 2009/0082120 | A1 * | 3/2009 | Johnson | 473/202 |
| 2009/0270194 | A1 * | 10/2009 | Casati, Jr. | 473/201 |
| 2010/0022323 | A1 * | 1/2010 | Thomas et al. | 473/307 |
| 2010/0041491 | A1 * | 2/2010 | Thomas et al. | 473/288 |

* cited by examiner

*Primary Examiner* — Stephen L. Blau
(74) *Attorney, Agent, or Firm* — Michael D. Eisenberg

(57) ABSTRACT

Sports training apparatuses, systems and methods for allowing a golf club user to estimate the trajectory and distance of a golf ball once it has been impacted with the golf club. One embodiment includes a golf club made up of a head, a ferrule, a shaft and a grip wherein one or more markings are positioned on said head, ferrule, shaft or grip or any combination of the head, ferrule, shaft and grip so the one or more markings may be used for monitoring and aiding in the improvement of the player's performance. The markings may be positioned at one or more locations about the external surface of one or more portions of the golf club including the head, the ferrule, the hosel, the shaft, and the grip. In other embodiments, additional markings may be used in conjunction with the first set of markings.

18 Claims, 3 Drawing Sheets

APPARATUSES, METHODS AND SYSTEMS FOR IMPROVING SPORTS PLAYING ABILITIES

CROSS-REFERENCES TO OTHER RELATED PATENT APPLICATIONS

This application claims the benefit of U.S. Provisional Application Ser. No. 61/212,220 filed on Apr. 9, 2009, which is incorporated herein by reference in its entirety.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISK APPENDIX

Not Applicable.

SUMMARY

Embodiments of the claimed subject matter include sports training apparatuses which include a golf club made up of a head, a shaft and a grip wherein one or more markings are positioned on said head, shaft or grip or any combination of the head, ferrule, shaft and grip so said one or more markings may be used for monitoring and aiding in improvement of the player's performance. Other embodiments of the golf club have a ferrule which also may have one or more markings positioned on its exterior so that they can be used for monitoring and aiding in the improvement of the player's performance.

Other embodiments include the above described apparatus with the markings positioned at one or more locations about the external surface of one or more portions of the golf club. These portions include the head, the ferrule, the hosel, the shaft, and the grip. In yet other embodiments, two or more sets of markings are positioned on at least two different of the above described portions of the golf club. Other embodiments include the above described apparatus with the markings positioned at two or more of the described locations about the external surface of two or more portions or sections of the golf club. In several of these embodiments, the markings are positioned about the periphery of the one or more portions at least 10 degrees apart from one another. The markings may also be placed less or more than 10 degrees apart from each other depending on the desires of the user. Other embodiments can be used with other types of sport sticks such as hockey sticks and lacrosse sticks. Yet other embodiments use external sources of light such as lasers or other lighting to apply the markings to the portions of the club. Other embodiments include systems and methods using the above described apparatuses.

BACKGROUND

Embodiments of the claimed subject matter relate to sports equipment which can be used to help a user improve his or her skill level, and more particularly several embodiments relate to golf clubs such as golf irons, woods and hybrid style clubs. In the past, golf club manufacturers have used a variety of different manufacturing processes to manufacture golf clubs, some of which may be kept as trade secrets. Regardless of the process used, irons, woods and hybrid clubs have been typically designed in the same manner.

Golf is played with a set of clubs with each club designed to launch the ball at a desired trajectory and distance. The variations available in trajectory and distance are achieved with the use of a set of clubs with varying lengths and lofts and each club is uniquely identified by a numbering system and/or with a loft designation displayed on the club head. Golfers learn the approximate distance the ball will travel when hit by each club swung in a normal manner. The golfer can then select an appropriate club to execute a particular shot so the ball travels over a desired distance and trajectory so it has a greater chance of reaching its target. Varying distances as well as various trajectories may be achieved with individual clubs and each club can be used to hit the ball with additional adjustments for distance and trajectory through the manipulation of the loft and the length of the club. Other adjustments that can be made by the player to affect the ball's distance and trajectory include the manner in which the club is held in the player's hands. Similarly, the length of the club can be made shorter or longer by gripping the club lower or higher on the grip end of the club. The effective loft of the club may also be adjusted by rotating the grip in the player's hands thereby turning the club face to the right or the left of the center position.

A "club head" also known as a "golf club head" has several elements. A typical club head includes a sole/bottom, a face which is the hitting surface, a crown (the top in wood clubs), and a top line (iron clubs). Formed into the heel of the club head is a hosel which receives the shaft. In conventional clubs the hosel is positioned within the heel with no markings or indicators. In the prior art, the user positions the golf club by visually aligning the face to the desired target in an attempt to create the intended face angle specified by the manufacturer. Club manufacturers endeavor to change face angles by producing a variety of club heads, with each head employing a specific angle that is used to strike the ball.

DETAILED DESCRIPTION OF THE EMBODIMENTS

Embodiments of the claimed subject matter use visual indicators with existing sporting devices such as clubs and sticks. In several golf club embodiments, visual indicators or markings may be used by the user/player to aid in the adjustment of the face angle of the club head. The face angle position of the golf club face is the angle relative to the intended line of ball flight. This angle can vary for different players. Other embodiments similarly use markings to aid in the adjustment of the striking face, such as the striking face of a stick used in the sport of hockey or as the catching face of a stick in the sport of lacrosse. Using the visual markings or indicators on a golf club, a golf player can minimize his or her problems of visually adjusting the face angle. Other users such as golf instructors can also use the visual markings to gauge whether or not the player is properly using the golf club. Additionally visual markings or indicators may also be used to offer more than one club head face angle.

One aspect of the embodiments is to provide a golf club training system, method and apparatus which include a set of markings on one or more of the components of the club including the head, shaft, grip and ferrule so that the set of markings can aid the player and/or the player's coach in estimating the characteristics of the flight of the ball being impacted, for instance the estimated trajectory and distance for any given golf shot.

Figure 2:
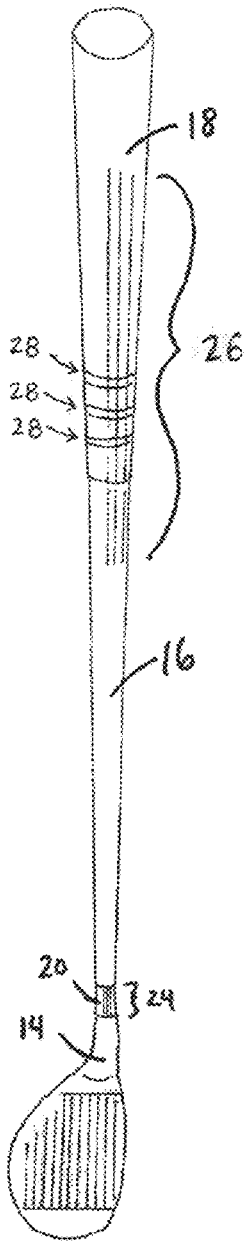
FIG. 2 is a elevational perspective view of a golf club of an embodiment of the claimed subject matter.
Figure 1:
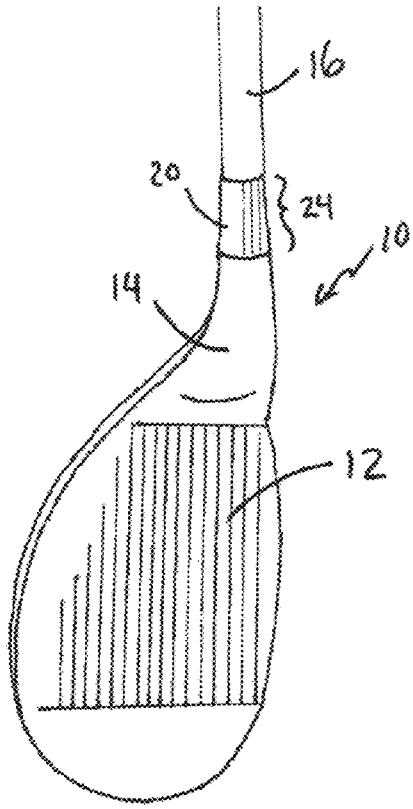
FIG. 1 is a top view of a club head and hosel of an embodiment of the claimed subject matter.

Referring now to the figures, FIG. 1 discloses a club head 10, also commonly referred to as an iron, having a striking surface denoted by a set of grooves 12 positioned in parallel configuration across the front facing surface of the head 10 and a hosel 14. The hosel 14 of the club head provides an attachment for a club shaft 16 which is partially shown protruding from and extending outward from the hosel 14 and extending through the ferrule 20. The distal end of the shaft 16 extends to at least the grip 18 of the club as illustrated in FIG. 2. FIG. 2 also illustrates an embodiment with the assembled club shaft 16 with a golf grip 18 at its distal end.

In some of the embodiments, a ferrule 20 is shown positioned on the golf club just above the hosel 14. A ferrule is typically a plastic or metal alloy sleeve that adorns the bottom of many steel and graphite golf club shafts just above the club head hosel. Ferrules can be used to dampen vibration and/or for aesthetic purposes.

In these embodiments, the golf grip 18 overlays the distal or outward end of the club shaft 16 and the grip 18 is attached thereto by a fastener such as glue type of fastener. The grip 18 may be attached using any known fastening process suitable to one skilled in the art and the grip 18 may be removable with a fastener which would allow the grip 18 to be applied and reapplied by a user. FIGS. 1 and 2 also illustrate embodiments having markings 24 positioned in a vertical orientation on the ferrule 20 and markings 28 positioned in a horizontal orientation on both portions of grip 18 and portions of the upper/distal end of shaft 16. These markings 24 and 28 are used in the embodiments as visual indicators for the player or another person to calibrate and/or estimate the position of the golf club before it is used to swing and hit or impact the ball.

Figure 3:
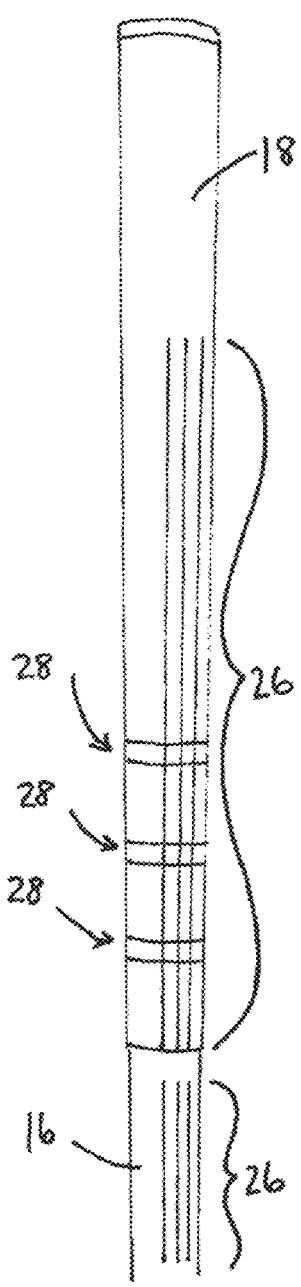
FIG. 3 is a side view of a golf grip and portion of a shaft of an embodiment of the claimed subject matter.

In FIGS. 1-3, the markings 24 and 26 are illustrated as positioned in parallel in a vertical orientation in relation to the longitudinal axis of the club shaft 16 and the markings 28 are illustrated as positioned in a horizontal orientation. The markings 24, 26 and 28 are also shown spaced apart from each other in equal spacing amounts. Other embodiments may have additional markings or markings in different configurations such as single dots and the space between the individual markings may also be varied. For example, markings 26 may be different on portions of the grip 18 and portions of the distal end of shaft 16 as illustrated in FIG. 3.

In other embodiments, one or more of the markings can be applied to the grip, shaft, hosel and/or ferrule of an existing club rather than being integrated into a newly manufactured golf clubs. The one or more markings can also be applied in other manners such as with an external application device so that the grip is imprinted or branded with the markings. Additionally, any number of suitable markings may be externally applied to one or more positions on the golf club using any fashion known to those skilled in the art. For example, a sticker having markings 24 may be affixed to the external surface of the grip 18 and/or the upper end of shaft 16 and another sticker may be used to affix the markings to the outer surface of the hosel 14. In other embodiments, a user or instructor can apply one or more removable markings with a coating or sticker.

Figure 4:
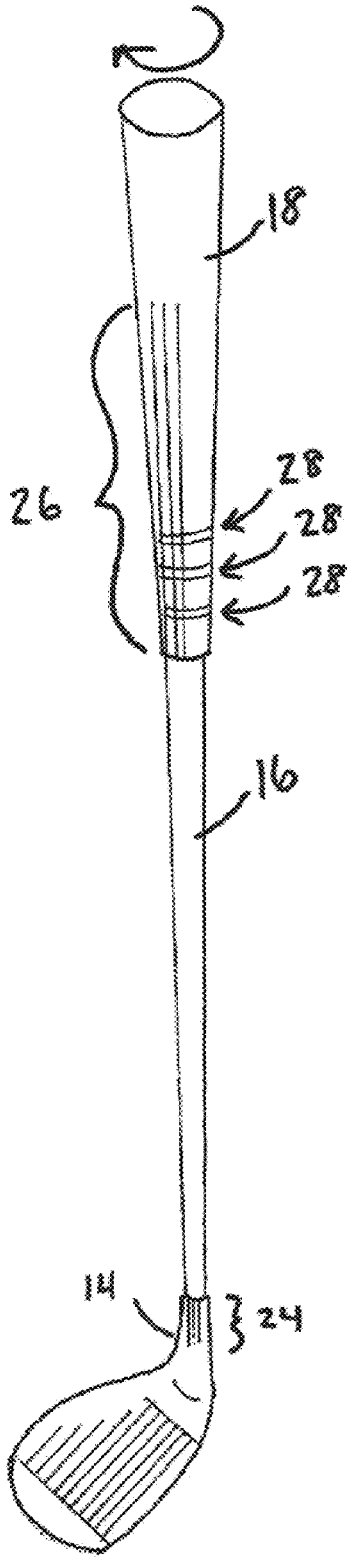
FIG. 4 is a perspective view of the club head and hosel rotated at a first angle according to an embodiment of the claimed subject matter.
Figure 5:
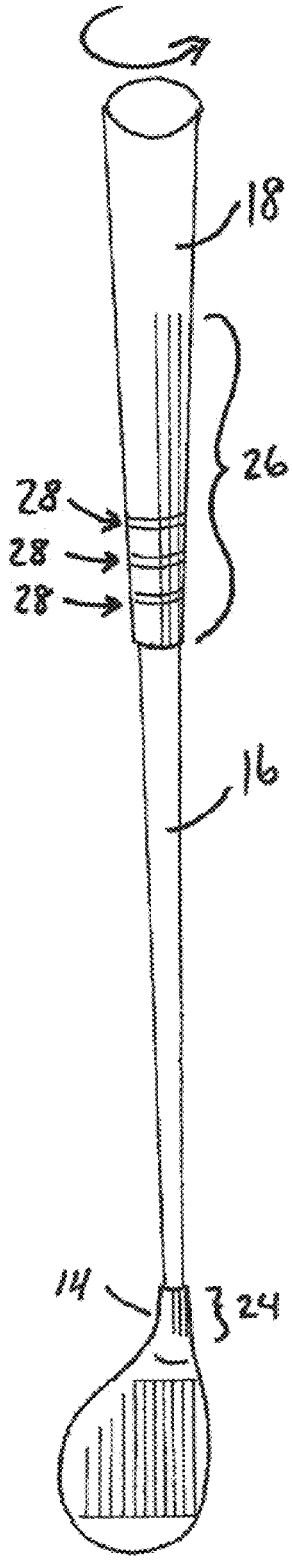
FIG. 5 is a perspective view of the club head and hosel rotated at a second angle according to an embodiment of the claimed subject matter.

FIG. 3 illustrates the golf grip 18 and upper portion of the shaft 16 which is connected to the grip 18 along with a plurality of vertical markings 26 and horizontal markings 28. The line markings shown in the figure act as visual or tactile indicators on the grip, and are positioned parallel to the longitudinal axis of the grip, and corresponding to the visual indicators inscribed on the shaft, ferrule and hosel, such that when the grip and club shaft are rotated about the longitudinal axis of the club shaft as shown in FIGS. 4 and 5, the visual indicator markings on the hosel 14 and the lines positioned on the grip 18 are in alignment when in use.

In several embodiments, when the golf club is held in the neutral position, a first marking, e.g. a visual or tactile marking line positioned on the golf grip 18, is directly in the view or in touch of the golfer, and the bottom surface of the club head lies perpendicular to the intended line of flight, therefore providing maximum distance of flight when the golf ball is impacted or struck. In other embodiments, the first marking may not be directly in view of the played when the player is in the neutral position. Other variations and embodiments may also be used as desired by the player or a third party such as the instructor or designer/manufacturer.

Auditory feedback may also be used to reference various alignment positions, for example if the shaft were rotated in one position and then rotated to another position a noise could be emitted from a noise emitter located within the club components. Any suitable electronic or non electronic noise emitter responding to the one or more positions of the shaft alignment known to those skilled in the art may be used.

Other embodiments include one or more markings positioned circumferentially about the grip portion of the club. These markings 28 may be placed at pre-selected locations along the axis of the grip for calibrating additional distances of the golf shot. In these embodiments illustrated in FIGS. 2-5, the markings 28 positioned on the grip 18 can be used to position the players hands on the grip 18 so that the effective length of the club which is to be swung is changed according to the needs of the player. These embodiments allow the user to maintain the club head so it may be used in a predictable manner while at the same time allowing for an offering of several face angles and that aid in the player's improved performance by allowing the user to deliver the club head to an impact position which is based on the player's needs.

Figure 6:
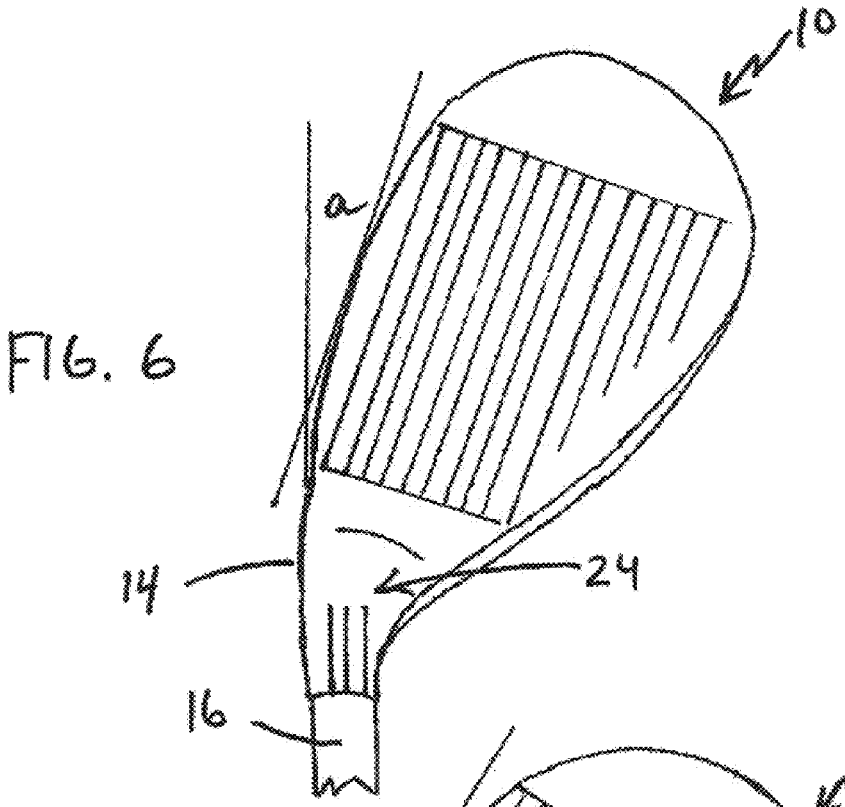
FIG. 6 is an exploded perspective view of the club head and hosel rotated at a first angle according to an embodiment of the claimed subject matter.
Figure 7:
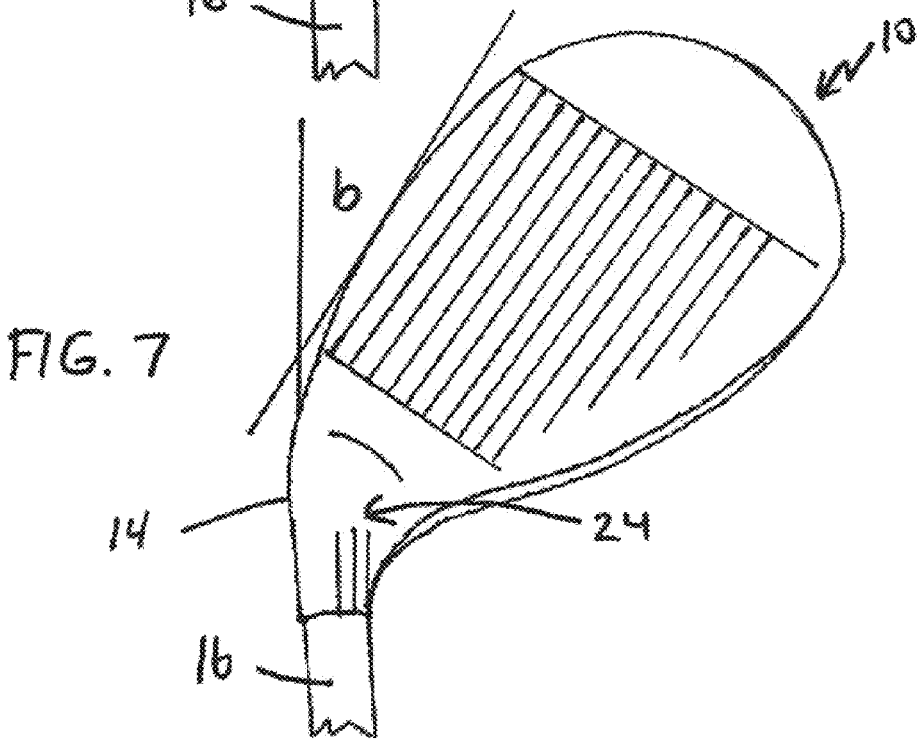
FIG. 7 is an exploded perspective view of the club head and hosel rotated at a second angle according to an embodiment of the claimed subject matter.

Referring now to FIGS. 6 and 7, the markings 24 are used by rotating the golf shaft about its longitudinal axis in prescribed amounts of rotation. In these embodiments, the rotation of the shaft causes the club head to correspondingly rotate to selected degrees (a and b) from the longitudinal axis of the club shaft. This results in a situation known as laying the club face open. Golf shots made with the club laid open are typically higher and shorter. Since the markings or visual indicators inscribed in the hosel, ferrule and/or shaft are in alignment with the markings (visual or tactile) lines formed on the grip, and when the golf club is held in reference to the lines on the grip, the distance of travel of the golf ball can easily be calibrated and repeated. In several embodiments, the markings are positioned at one or more pre-selected locations along the length and/or axis of the grip. These markings can be used for adjusting the user's golf shot, for instance when the markings are used with an existing golf club or when they are manufactured into a golf club's body, such as the golf club's grip. Other embodiments include one or more markings and/or inscriptions positioned circumferentially about the grip portion of the club.

Other embodiments include clubs with markings such as raised tactile inscriptions such as bumps or grooves may also be used or they may be used in conjunction with visual markings. In any of the embodiments, the markings used for estimating the character of the resulting hit or catch can be vertical, horizontal or of any suitable shape and size. The markings may be inscribed into the outer surface of the grip or any other portion of the club or stick which can be viewed by the user or by another user such as an instructor observing the player. Other areas of the club include interior portions of the club which can be viewed through the grip such markings positioned under a clear plastic grip. Several of the embodiments include the use of a sticker having markings suitably positioned and spaced around the periphery of the club's grip.

A range of face angle positions are possible by placing the markings on either a single component, the head, shaft, ferrule and grip, all, and/or a combination of these components so that the player/user of the golf club or any other person observing the player, such as an instructor, can use the markings to estimate the change in position of the golf club in the player's hands. The changes made to the position of the golf club would enable the player to make allowances for making changes to the distance and/or the flight characteristics of the golf ball being impacted. The characteristics of the flight of the ball include the vertical angle of the flight from the ground, the estimated highest flight level of the golf ball and the horizontal angle of the ball's flight. These embodiments allow the user to make adjustments to the position of the golf club in the user's hands before taking a swing while at the same time allowing the golf club head and body to be maintained in a consistent manner.

In this way, a player can use the markings to estimate the characteristics of the flight and distance of the ball being impacted before it is impacted and the player can compare the results to the position used to further calibrate the positions of the markings with the resulting characteristics of the golf ball's flight. Thus, the various golf head face angles facilitated by the markings can deliver differing impact positions to the golf ball and these varying positions can be based on the individual player type's needs or the changes made by others such as a golf instructor in order to aid in the improvement of the player's performance.

In other embodiments, a number of computer implemented user interface elements allow additional functionality to the marking apparatuses, systems and methods. For example, a club grip may include one or more computer or electronic implemented haptic feedback functions such as those found in the DUALSHOCK controller manufactured by Sony Computer Entertainment, Inc. or the Wii Remote manufactured by Nintendo Co., Ltd.

In one of these embodiments, a haptic feedback component is included into the grip. This component is manufactured integrally into the grip so it is not visible to the player but at the same time can be controlled remotely with a remote interface element. The output could be a remote signal such as one sent through a radio frequency wave to a receiver such as a Bluetooth headset. The component in several embodiments may also include a vibration component to signal the player when the golf club is positioned in a proper orientation, another predetermined orientation, a user preset orientation, or when the club is placed in one orientation versus another orientation.

In another embodiment similar in functionality to the Wii Remote, the golf club has the ability to sense acceleration along three axes through the use of an accelerometer such as the ADXL330 accelerometer used in the Wii Remote. One or more additional sensors may also be used to determine the orientation of one or more components of the club. Another embodiment could be used as a Wii Remote is used for use in a video game that is programmed to train the user to make swings in various directions and orientations. With these embodiments, a player could practice using a gaming console that uses video from previously recorded games as references.

Other embodiments track the movement and orientation of the golf club in the field by recording the acceleration along three axes that is senses and playing it back alongside one or more videos of the golf swings and results. In this way, a player could effectively record the club's swing in three dimensions and match the results of the swing and impacts with the actual video results allowing the player to fine tune his or her playing style helping improve the player's ability in that sport, such as the sport of golf in this embodiment. Additional components that may be included with such a training device is a haptic display and other electronic implemented devices which can sense as well as record, if needed, the finger and hand pressure and placement on the grip. These components may also record the sensory output from the components so that they may be played back with other sensor output signals alongside a recording of the actual golf shot so that the parameters used on the golf club as well as the position and movement of the golf club may be tracked to the results of the actual swing used in the field to impact the golf ball.

While several embodiments of the claimed subject matter have been described, other variations may also be used for estimating the characteristics of golf shots as well as for calibrating the distances and loft for any number of golf shots. The described markings or visual indicators on portions of the golf club, including markings on the hosel and corresponding markings on the grip may be visual or tactile and they may include electronic means such as vibration components. Lines in the grip may also be employed for closing the face of the club head such that predictable and repeatable distances may also be obtained.

It should be understood, however, that the disclosed embodiments are mere exemplary embodiments of the claimed subject matter and as such the claimed subject matter is not limited to the above described embodiments. As such, the details disclosed herein are not to be interpreted as limiting, but rather should be used as a basis to exemplify the claimed subject matter as well as for providing sufficient written description and the teaching of those skilled in the art how to both make and use the claimed subject matter.

What is claimed is:

1. A golf club swing aid disposed on a golf club, for adjusting the character of the swing of the club which is to be applied to a ball, comprising:

a golf club having a grip, a shaft, a ferrule and head;

a neutral vertical marking formed on a surface of the grip, parallel with the length of the shaft and formed such that when the club is held by a golfer with the neutral vertical marking positioned at twelve o' clock, along the entire length of the vertical marking, from the golfer's view point looking down the shaft of the club, the club is in its neutral position;

a plurality of vertical markings spaced apart from the neutral vertical marking, formed such that when the club is held by a golfer with any of the plurality of vertical markings positioned at twelve o' clock, along the entire length of the vertical marking, from the golfer's view point looking down the shaft of the club, the club face is an open position;

wherein vertical markings spaced further apart from the neutral vertical marking result in the club face open to a greater degree when the club is held by a golfer with any of the plurality of vertical markings positioned at twelve o' clock from the golfer's view point looking down the shaft of the club;

a plurality of spaced apart parallel horizontal markings intersecting the vertical markings on the grip, forming intersection points to indicate to a golfer where to place the golfers hands along the grip, the spacing of the horizontal markings causing the effective length of the club to increase or decrease depending on which horizontal marking on which the golfer grips the club;

a plurality of vertical markings disposed on the ferrule, coplanar with the plurality of vertical markings on the grip, at least one being a neutral vertical marking formed on a surface of the ferrule, parallel with the length of the ferrule and formed such that when the club is held by a golfer with the neutral vertical marking positioned at twelve o' clock from the golfer's view point looking down the ferrule, the club is in its neutral position and the neutral markings on the grip and ferrule both being aligned with each other such that both are in the twelve o' clock position when the club is in the neutral position; and wherein the golf club swing aid allows a golfer to consistently select appropriate grip adjusting opening the club face or adjusting the effective length of the club.

2. The golf club swing aid of claim 1, wherein the vertical markings are spaced apart at between 10-15 degree intervals.

3. The golf club swing aid of claim 1, wherein the vertical markings are spaced apart at between 15-20 degree intervals.

4. The golf club swing aid of claim 1, wherein the intersections points are disposed at a distance greater than half way down the grip from a top end of the club.

5. A golf club swing aid disposed on a golf club, for adjusting the character of the swing of the club which is to be applied to a ball, comprising:

a golf club having a grip, a shaft, a ferrule connected to the shaft distal to the grip and a head;

a neutral vertical marking formed on a surface of the grip, parallel with the length of the shaft and formed such that when the club is held by a golfer with the neutral vertical marking positioned at twelve o' clock from the golfer's view point looking down the shaft of the club, the club is in its neutral position;

a plurality of vertical markings spaced apart from the neutral vertical marking, formed such that when the club is held by a golfer with any of the plurality of vertical markings positioned at twelve o' clock from the golfer's view point looking down the shaft of the club, the club face is an open position;

wherein vertical markings spaced further apart from the neutral vertical marking result in the club face open to a greater degree when the club is held by a golfer with any of the plurality of vertical markings positioned at twelve o' clock from the golfer's view point looking down the shaft of the club;

a plurality of spaced apart parallel horizontal markings intersecting the vertical markings on the grip, forming intersection points to indicate to a golfer where to place the golfers hands along the grip, the spacing of the horizontal markings causing the effective length of the club to increase or decrease depending on which horizontal marking on which the golfer grips the club;

a plurality of vertical markings disposed on the ferrule, aligned with the plurality of vertical markings on the grip, at least one being a neutral vertical marking formed on a surface of the ferrule, parallel with the length of the ferrule and formed such that when the club is held by a golfer with the neutral vertical marking positioned at twelve o' clock from the golfer's view point looking down the ferrule, the club is in its neutral position and the neutral markings on the grip and ferrule both being aligned with each other such that both are in the twelve o' clock position when the club is in the neutral position; and wherein the golf club swing aid allows a golfer to consistently select appropriate grip adjusting opening the club face or adjusting the effective length of the club.

6. The golf club swing aid of claim 5, wherein the golf club further comprises:

a plurality of vertical markings disposed on the head, aligned with the plurality of vertical markings on the grip, at least one being a neutral vertical marking formed on a surface of the head, parallel with the length of the head and formed such that when the club is held by a golfer with the neutral vertical marking positioned at twelve o' clock from the golfer's view point looking down the head, the club is in its neutral position and the neutral markings on the grip and head both being aligned with each other such that both are in the twelve o' clock position when the club is in the neutral position.

7. The golf club swing aid of claim 5, wherein the golf club further comprises a hosel, the golf club swing aid comprising:

a plurality of vertical markings disposed on the hosel, aligned with the plurality of vertical markings on the grip, at least one being a neutral vertical marking formed on a surface of the hosel, parallel with the length of the hosel and formed such that when the club is held by a golfer with the neutral vertical marking positioned at twelve o' clock from the golfer's view point looking down the hosel, the club is in its neutral position and the neutral markings on the grip and hosel both being aligned with each other such that both are in the twelve o' clock position when the club is in the neutral position.

8. The golf club swing aid of claim 5, wherein the vertical markings are spaced apart at between 10-15 degree intervals.

9. The golf club swing aid of claim 5, wherein the vertical markings are spaced apart at between 15-20 degree intervals.

10. The golf club swing aid of claim 5, wherein the intersections points are disposed at a distance greater than half way down the grip from a top end of the club.

11. The golf club swing aid of claim 5 , wherein the vertical markings are spaced apart at regular intervals from the neutral vertical marking and the horizontal markings are spaced apart at regular intervals.

12. A golf club swing aid disposed on a golf club, for adjusting the character of the swing of the club which is to be applied to a ball, comprising:

a golf club having a grip, a shaft, and a head;

a neutral vertical line formed on a surface of the grip, parallel with the length of the shaft and formed such that when the club is held by a golfer with the neutral vertical line positioned at twelve o' clock, along the entire length of the vertical line, from the golfer's view point looking down the shaft of the club, the club is in its neutral position;

a plurality of vertical lines spaced apart from the neutral vertical line, formed such that when the club is held by a golfer with any of the plurality of vertical lines positioned at twelve o' clock, along the entire length of the vertical line, from the golfer's view point looking down the shaft of the club, the club face is in an open position;

wherein vertical lines spaced further apart from the neutral vertical line result in the club face being open to a greater degree when the club is held by a golfer with any of the plurality of vertical lines positioned at twelve o' clock from the golfer's view point looking down the shaft of the club;

a plurality of spaced apart parallel horizontal lines intersecting the vertical lines on the grip, forming intersection points to indicate to a golfer where to place the golfers hands along the grip, the spacing of the horizontal lines causing the effective length of the club to increase or decrease depending on which horizontal line on which the golfer grips the club;

a plurality of vertical lines disposed on a bottom end of the club, coplanar with the plurality of vertical lines on the grip, at least one being a neutral vertical line formed on a surface of the bottom end of the club, parallel with the length of the head and formed such that when the club is held by a golfer with the neutral vertical line positioned at twelve o' clock from the golfer's view point looking down the bottom end of the club , the club is in its neutral position and the neutral lines on the grip and the bottom end of the club both being aligned with each other such that both are in the twelve o' clock position when the club is in the neutral position; and wherein the golf club swing aid allows a golfer to consistently select appropriate grip adjusting opening the club face or adjusting the effective length of the club;

wherein the vertical lines are spaced apart at between 10-20 degree intervals;

wherein the intersections points are disposed at a distance greater than half way down the grip from a top end of the club.

13. The golf club swing aid of claim 12, wherein the bottom end of the club comprises a hosel and vertical lines are disposed on the hosel.

14. The golf club swing aid of claim 13, wherein the vertical lines are spaced apart at between 15-20 degree intervals.

15. The golf club swing aid of claim 13, wherein the vertical lines are spaced apart at between 10-15 degree intervals.

16. The golf club swing aid of claim 12, wherein the bottom end of the club comprises a ferrule and vertical lines are disposed on the ferrule.

17. The golf club swing aid of claim 16, wherein the vertical lines are spaced apart at between 15-20 degree intervals.

18. The golf club swing aid of claim 16, wherein the vertical lines are spaced apart at between 10-15 degree intervals.

* * * * *